US005476727A

United States Patent [19]

Maruta

[11] Patent Number: 5,476,727

[45] Date of Patent: Dec. 19, 1995

[54] THIN FILM ELECTROLUMINESCENCE DISPLAY ELEMENT

[75] Inventor: Yukihiro Maruta, Kanagawa, Japan

[73] Assignee: Fuji Electric Co., Ltd., Kanagawa, Japan

[21] Appl. No.: 121,862

[22] Filed: Sep. 17, 1993

[30] Foreign Application Priority Data

Sep. 24, 1992 [JP] Japan ..... 4-253349

[51] Int. Cl.[6] ..... H05D 33/22

[52] U.S. Cl. ..... 428/690; 428/691; 428/917; 313/506; 313/509; 313/512

[58] Field of Search ..... 428/690, 917, 428/691; 313/506, 509, 512

[56] References Cited

U.S. PATENT DOCUMENTS

| | | | |
|---|---|---|---|
| 4,495,219 | 1/1985 | Kato et al. | 427/82 |
| 4,670,355 | 6/1987 | Matsudaira | 428/690 |
| 4,693,906 | 9/1987 | Lindmayer | 427/69 |
| 5,019,002 | 5/1991 | Holmberg | 445/24 |
| 5,072,263 | 12/1991 | Watanabe et al. | 357/17 |
| 5,225,286 | 7/1993 | Fujikawa et al. | 428/426 |

FOREIGN PATENT DOCUMENTS 1-320796 12/1989 Japan .

*Primary Examiner*—Charles R. Nold

*Attorney, Agent, or Firm*—Finnegan, Henderson, Farabow, Garrett & Dunner

[57] ABSTRACT

A thin film electroluminescence display element composed of a soda-lime glass substrate having provided thereon a barrier layer including tantalum (V) oxide, a transparent indium-tin oxide (ITO) electrode as a first electrode, a first insulating layer, a luminescent layer, a second insulating layer, and a second electrode is disclosed. The tantalum (V) oxide barrier layer effectively prevents sodium in the soda-lime glass substrate from diffusing into the ITO transparent electrode.

10 Claims, 3 Drawing Sheets

THIN FILM ELECTROLUMINESCENCE DISPLAY ELEMENT

FIELD OF THE INVENTION

This invention relates to a thin film electroluminescence display element and more particularly, a thin film electroluminescence display element having a barrier layer against diffusion of sodium.

BACKGROUND OF THE INVENTION

Thin film electroluminescence (hereinafter abbreviated as TFEL) displays having a so-called double insulation structure composed of a luminescent layer comprising a fluorescent substance containing manganese as an activator or luminescence center which is sandwiched in between a transparent electrode (indium-tin oxide, hereinafter abbreviated as ITO) and a metallic electrode via an insulating layer on each side thereof have been recognized as a promising technology for flat panel displays because of their high luminance, high resolving power and feasibility of large volume displaying.

In FIG. 7 is shown a perspective cutaway view of the main part of a conventional double insulation type TFEL display element. As shown in FIG. 7, the conventional TFEL display element is composed of glass substrate 1, ITO transparent electrode 2 (first electrode), insulating layer 3 comprising $SiO_2$, $Si_3N_4$, etc. (first insulating layer), luminescent layer 4, second insulating layer 5 made of the same material as the first insulating layer, and aluminum electrode 6 (second electrode).

The luminescent layer comprises zinc sulfide as a matrix having added thereto a small amount of manganese as a luminescence center. The luminescence center Mn has an optimal concentration ranging from 0.4 to 0.6% by weight based on zinc sulfide for obtaining a practical luminance of at least 100 cd/m$^2$. Such a luminescent layer is produced by vacuum evaporation, sputtering, an ALE (Atomic Layer Epitaxy) method, etc. followed by annealing in high temperatures for dispersing manganese in the zinc sulfide matrix.

FIG. 8 shows a cross section of another example of a conventional double insulation type TFEL display element. this example, the element is sealed with silicon oil 8 and covered with sealing glass 7 for the purpose of preventing moisture in the atmosphere from entering the luminescent layer to thereby ensure the life of the element.

Where soda-lime glass is used as a glass substrate in these conventional TFEL display elements, sodium in soda-lime glass is diffused into the ITO transparent electrode, which results in an increase of electric resistance of the ITO transparent electrode, though depending on the process for preparing the ITO transparent electrode, to reduce the characteristics of the element.

In order to prevent sodium diffusion in simple matrix drive liquid crystal displays, a method of providing a barrier layer comprising $SiO_2$, etc. between a glass substrate and a transparent electrode has been employed. This method is effective in liquid crystal displays of simple matrix drive and the like but is ineffective in TFEL displays because of involvement of a high temperature treatment.

SUMMARY OF THE INVENTION

An object of the present invention is to provide a TFEL display element containing a barrier layer that prevents sodium diffusion even when treated in a high temperature, thereby exhibiting improved characteristics.

To achieve this and other objects of the present invention, a thin film electroluminescence display element comprises a soda-lime glass substrate; a barrier layer, over the substrate, including tantalum (V) oxide; a transparent indium-tin oxide electrode over the barrier layer; a first insulating layer over the transparent indium-tin oxide electrode; a luminescent layer over the first insulating layer; a second insulating layer over the luminescent layer; and another electrode over the second insulating layer.

According to the present invention, diffusion of sodium can be prevented by the barrier layer comprising tantalum (V) oxide even when a TFEL display element is subjected to a high temperature treatment.

BRIEF DESCRIPTION OF THE DRAWINGS

In FIGS. 1(*a*), 1(*b*) 7 and 8, 1 shows a glass substrate, 2 shows a transparent electrode, 3 shows a first insulating layer, 6 shows an A1 electrode, 7 shows a sealing glass, 8 shows a silicon oil, 9 shows a barrier layer and 10 shows a second barrier.

In FIGS. 2 to 5, ———— is a line for Na, — — — — for Al, - - - - - for Si, — — — for In and —— —— for Ta. In these FIGURES, "a.u." means arbitrary unit.

PREFERRED EMBODIMENTS OF THE INVENTION

Figure 1A:
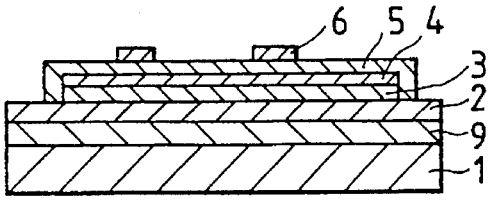
FIGS. 1(*a*) and 1(*b*) is a cross section of a TFEL display element according to a preferred embodiment of the present invention.
Figure 1B:
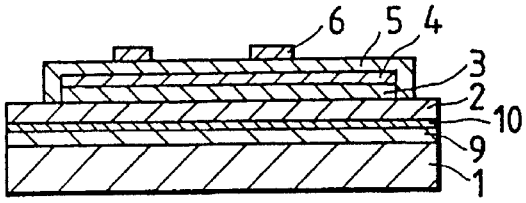

The preferred embodiment of the present invention will be illustrated by way of Examples. In general, the same reference numbers will be used throughout the drawings to refer to like parts. In FIG. 1(*a*) is shown the layer structure of the TFEL display element according to the present invention. Tantalum (V) oxide barrier layer 9 having a deposit thickness of 100 nm was formed on soda-lime glass substrate 1 by radiofrequency (RF) magnetron sputtering using sintered $Ta_2O_5$ as a target and oxygen and argon as sputtering gas. In the same vacuum chamber, ITO transparent electrode 2 was formed on the barrier layer, and first insulating layer 3 comprising $Al_2O_3$ was further formed thereon. The glass substrate having thereon barrier layer 9 and first insulating layer 3 was then subjected to annealing at 250° C., 350° C., 450° C. or 550° C. for 1 hour, followed by cooling at a cooling rate of 100° C./hr.

Diffusion of sodium from soda-lime glass depends on the heat treating temperature and time. The sodium diffusion profile in the thickness direction was determined by oxygen sputtering using an ion microanalyzer (IMA). The Na barrier properties were evaluated by the Na level in the alumina insulating layer. The results of evaluation are shown in Table 1 below, which compares sodium diffusion levels when a $Ta_2O_5$ barrier layer is present with levels when no barrier layer is present.

TABLE 1

| Annealing temp. | none | 350° C. | 450° C. | 550° C. |
|---|---|---|---|---|
| $Ta_2O_5$ barrier layer | good | good | good | good |
| No barrier layer | bad | bad | bad | bad |

Figure 2:
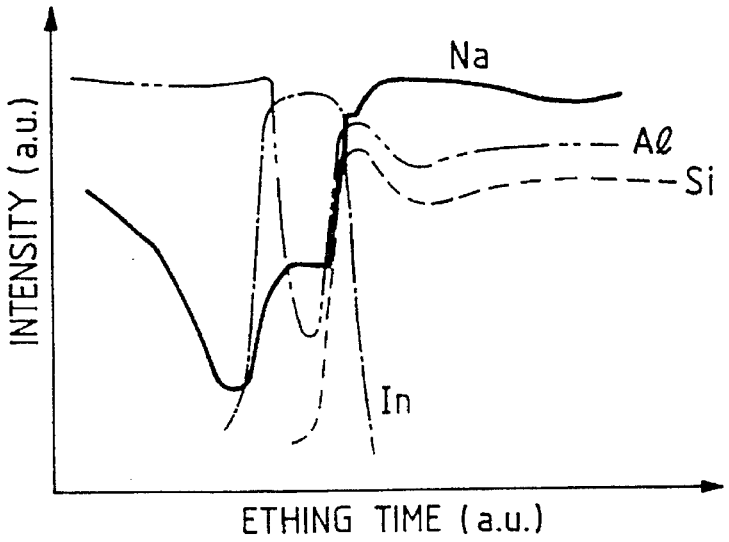
FIG. 2 is a graph showing a diffusion profile of various elements in a conventional TFEL display element having been subjected to annealing at 550° C.

FIG. 2 shows a diffusion profile of various elements in a conventional TFEL display element, with the annealing temperature being 550° C.

Figure 3:
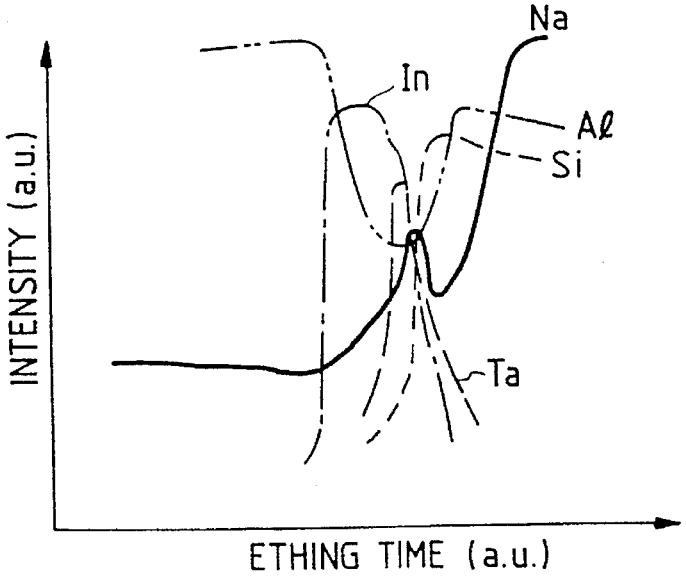
FIG. 3 is a graph showing a diffusion profile of various elements in a TFEL display element according to the preferred embodiment of the present invention having been subjected to annealing at 550° C.

FIG. 3 shows a diffusion profile of various elements in the TFEL display element of the preferred embodiment of the present invention, with the annealing temperature being 550° C.

It is seen from FIG. 2 that the Na level in the alumina insulating layer of the conventional element is high, apparently revealing diffusion of sodium of the soda-lime glass substrate into the element. To the contrary, it is seen from FIG. 3 that the $Ta_2O_3$ barrier layer has a high Na level, indicating that sodium is inhibited from diffusing into the insulating layer by the barrier layer.

Effects of an alumina barrier layer or a silica barrier layer were then examined in the same manner as described above. An alumina barrier layer was deposited to a thickness of 100 nm by RF magnetron sputtering using a sintered alumina target and $O_2$/Ar sputtering gas. A silica barrier layer was deposited to a thickness of 100 nm by magnetron sputtering using a quarts ($SiO_2$) target and $O_2$/Ar sputtering gas. The results obtained are shown in Table 2 below.

TABLE 2

| Annealing temp. | none | 350° C. | 450° C. | 550° C. |
|---|---|---|---|---|
| $Al_2O_3$ barrier layer | good | bad | bad | bad |
| $SiO_2$ barrier layer | good | good | bad | bad |

As is shown in Table 2, the alumina barrier layer formed by sputtering produces no barrier effect against Na when heat treated at 350° C. or higher. The silica layer exhibits Na barrier properties to some extent up to a heating temperature of 350° C. but no effects at 450° C. or higher. From all these results, it is obvious that the tantalum (V) oxide layer exhibits superior Na barrier properties.

Figure 4:
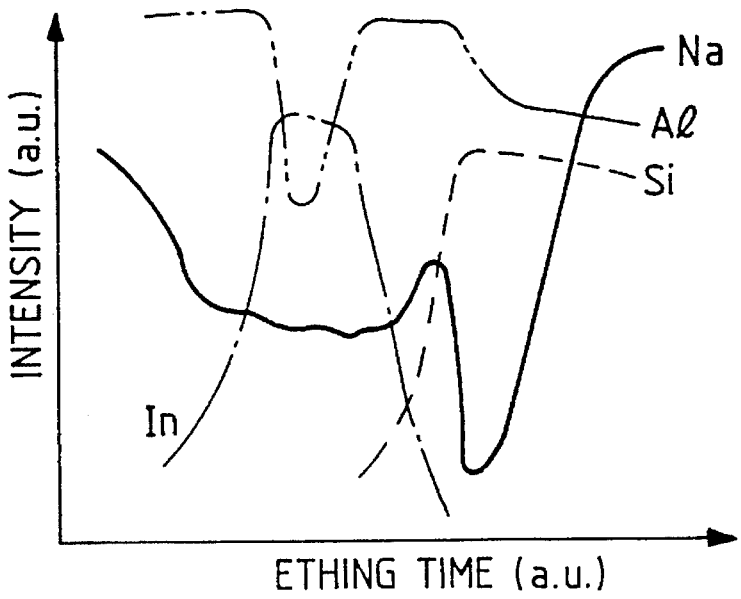
FIG. 4 shows an element distribution in a TFEL display element using an alumina ($Al_2O_3$) barrier layer.
Figure 5:
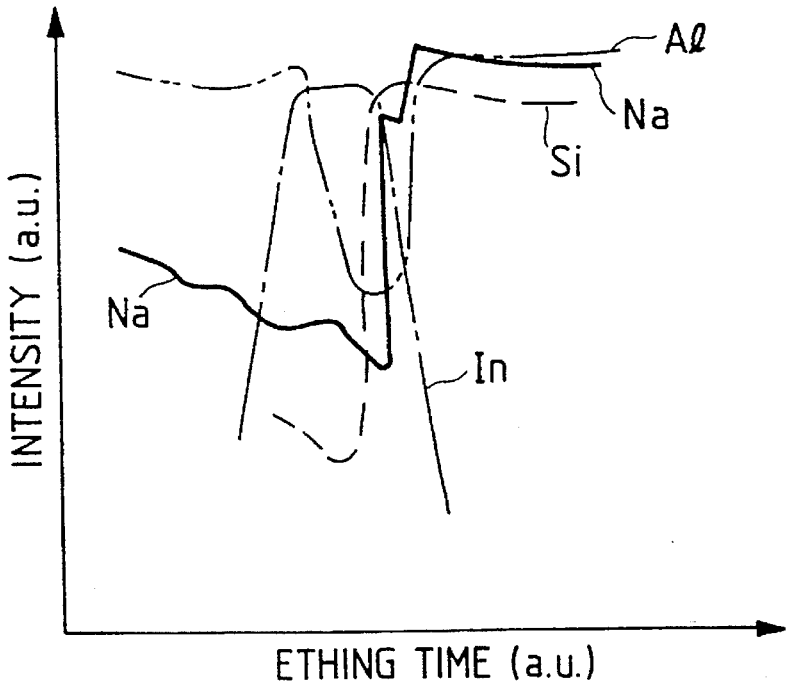
FIG. 5 shows an element distribution in a TFEL display element using a silica ($SiO_2$) barrier layer.

FIGS. 4 and 5 each show an element distribution in a TFEL display element using an alumina barrier layer or a silica barrier layer, respectively, both annealed at 550° C.

The resistivity of the ITO transparent electrode was measured before and after annealing at 450° C. or 550° C. Where a tantalum (V) oxide barrier layer was provided, increase of the resistivity was observed before and after the heat treatment.

Figure 6:
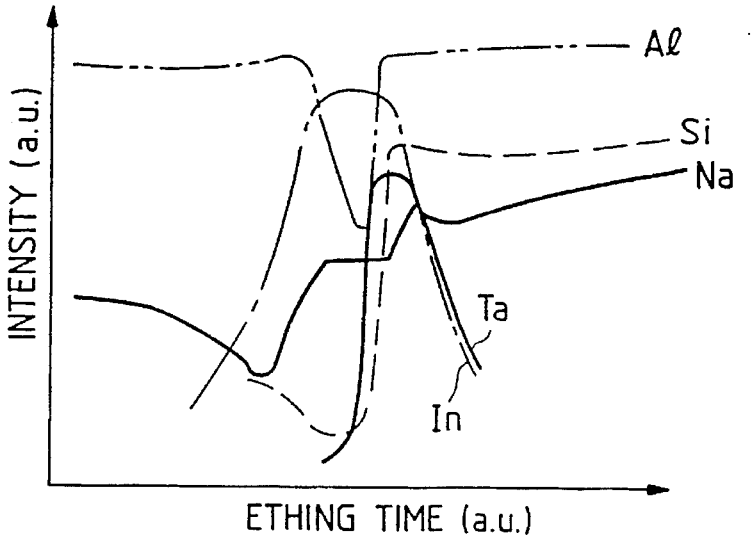
FIG. 6 shows an element distribution in a TFEL display element using an alkali-free glass substrate having thereon a tantalum (V) oxide barrier layer.
Figure 7:
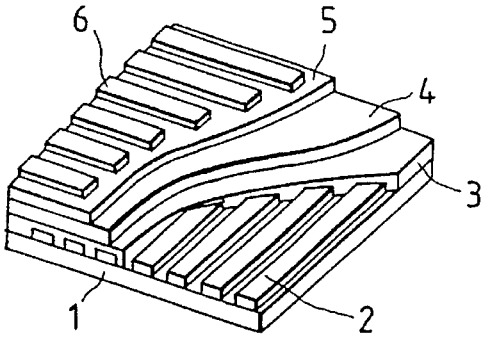
FIG. 7 PRIOR ART
FIG. 7 is a perspective cutaway view of a conventional double insulation type TFEL display element.
Figure 8:
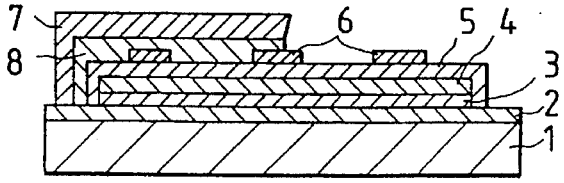
FIG. 8 PRIOR ART
FIG. 8 is a sectional view of another conventional double insulation type TFEL display element.

FIG. 6 shows an element distribution in a TFEL display element using an alkali-free (alkali metal free) glass substrate having thereon a tantalum (V) oxide barrier layer as measured with IMA. The annealing temperature was 550° C. No sodium diffusion observed. Accordingly, increase of the resistivity is no caused by sodium diffusion, the cause of seems to be increase of the resistivity that oxygen in tantalum (V) oxide migrates into the ITO transparent electrode during the heat treatment to reduce the carrier density in the ITO transparent electrode.

In order to inhibit the above-mentioned increase in resistivity of the ITO transparent electrode, a silica or alumina layer was deposited on a tantalum (V) oxide layer to a thickness of 20 nm as a second barrier 10 in FIG. 1(*b*), and an ITO transparent electrode was formed thereon. On examining the change of resistivity of the ITO transparent electrode due to a heat treatment, it was found that a resistivity increase can be inhibited even when a heat treatment was conducted at 550° C.

Accordingly, as far as a heat-treating temperature after formation of an ITO transparent electrode is not more than 350° C., sodium diffusion can be inhibited by providing a tantalum (V) oxide barrier layer between a soda-lime glass substrate and an ITO transparent electrode. Where a heat treatment is conducted at a temperature higher than 350° C. and up to about 550° C., not only sodium diffusion but the above-described adverse influence of the tantalum (V) oxide barrier layer on the ITO transparent electrode can be inhibited by further providing a silica layer or an alumina layer between the tantalum (V) oxide barrier layer and the ITO transparent electrode.

As described and demonstrated above, the present invention provides a TFEL display element in which diffusion of sodium into an ITO transparent electrode can be inhibited even when the element is subjected to a high temperature heat treatment to thereby exhibit excellent performance characteristics.

While the invention has been described in detail and with reference to specific examples thereof, it will be apparent to one skilled in the art that various changes and modifications can be made therein without departing from the spirit and scope thereof.

What is claimed is:

1. A thin film electroluminescence display element comprising:

a soda-lime glass substrate;

a barrier layer comprising a first layer on the substrate including tantalum (V) oxide and a second layer on the first layer inhibiting migration of oxygen from the tantalum (V) oxide, said second layer comprising at least one of silica and alumina;

a transparent indium-tin oxide electrode on the barrier layer;

a first insulating layer on the indium-tin oxide electrode;

a luminescent layer on the first insulating layer;

a second insulating layer on the luminescent layer; and another electrode on the second insulating layer.

2. A thin film electroluminescence display element as claimed in claim 1, wherein the second layer of said barrier layer comprises silica.

3. A thin film electroluminescence display element as claimed in claim 1, wherein the second layer of said barrier layer comprises alumina.

4. A thin film electroluminescence display element as claimed in claim 1, wherein said first insulating layer includes alumina.

5. A thin film electroluminescence display element comprising:

a glass substrate;

a barrier layer comprising a first layer on the substrate including tantalum (V) oxide and a second layer on the first layer inhibiting migration of oxygen from the tantalum (V) oxide, said second layer comprising at least one of silica and alumina;

a transparent indium-tin oxide electrode on the barrier layer;

a first insulating layer on the indium-tin oxide electrode;

a luminescent layer on the first insulating layer;

a second insulating layer on the luminescent layer; and another electrode on the second insulating layer.

6. A thin film electroluminescence display element as claimed in claim 5, wherein said first insulating layer includes alumina.

7. A thin film electroluminescence display element as claimed in claim 5, wherein the glass substrate includes diffusible sodium.

8. A thin film electroluminescence display element comprising:

a substrate that permits the outdiffusion of sodium;

a barrier layer comprising a first layer on the substrate including tantalum (V) oxide and a second layer on the first layer inhibiting migration of oxygen from the tantalum (V) oxide, said second layer comprising at least one of silica and alumina;

a transparent indium-tin oxide electrode on the barrier layer;

a first insulating layer on the indium-tin oxide electrode;

a luminescent layer on the first insulating layer;

a second insulating layer on the luminescent layer; and another electrode on the second insulating layer.

9. A thin film electroluminescence display element as claimed in claim 8, wherein said first insulating layer includes alumina.

10. A thin film electroluminescence display element as claimed in claim 8, wherein the dielectric transparent substrate includes diffusible sodium.

* * * * *